United States Patent [19]

Jorgensen et al.

[11] Patent Number: 5,053,573

[45] Date of Patent: Oct. 1, 1991

[54] REDUCTION OF BENZENE CONTENT OF REFORMATE BY REACTION WITH CYCLE OILS

[75] Inventors: Diane V. Jorgensen, Wilmington, Del.; Ajit V. Sapre, West Berlin, N.J.

[73] Assignee: Mobil Oil Corporation, Fairfax, Va.

[21] Appl. No.: 583,273

[22] Filed: Sep. 14, 1990

[51] Int. Cl.[5] ..... C07C 5/22

[52] U.S. Cl. ..... 585/475; 585/467; 585/910; 585/904; 208/135; 208/141

[58] Field of Search ..... 585/467, 904, 416, 475; 208/66, 111, 135, 141

[56] References Cited

U.S. PATENT DOCUMENTS

| | | | |
|---|---|---|---|
| 2,739,991 | 3/1956 | Heruert | 266/672 |
| 2,996,447 | 8/1961 | Poiter et al. | 208/66 |
| 3,692,858 | 9/1972 | Brewer et al. | 208/84 |
| 3716,596 | 2/1973 | Bowes | 266/671 |
| 3,719,586 | 3/1973 | Benner | 208/66 |
| 3,763,260 | 10/1973 | Pollitzer | 588/475 |
| 3,855,328 | 12/1974 | Hedge | 260/668 |
| 3,873,434 | 3/1975 | Pellitzer et al. | 208/66 |
| 3,928,174 | 12/1975 | Bonacci et al. | 585/475 |
| 3,948,758 | 4/1976 | Bonacci et al. | 585/475 |
| 3,957,621 | 5/1976 | Bonacci et al. | 585/475 |
| 3,969,426 | 7/1976 | Owen et al. | 260/668 |
| 3,996,305 | 12/1976 | Berger | 585/475 |
| 4,112,056 | 9/1978 | Chen et al. | 208/111 |
| 4,136,128 | 1/1979 | Haag et al. | 260/671 R |
| 4,157,950 | 6/1979 | Frilette et al. | 585/475 |
| 4,172,813 | 10/1974 | Feinstein et al. | 585/475 |
| 4,209,383 | 5/1980 | Herout et al. | 208/93 |
| 4,237,329 | 12/1980 | Kamiyama et al. | 585/475 |
| 4,320,242 | 3/1982 | Onodera et al. | 585/484 |
| 4,454,364 | 6/1984 | Farcasiu et al. | 585/470 |
| 4,469,908 | 9/1984 | Buress | 585/467 |
| 4,504,690 | 3/1985 | Forbus et al. | 585/467 |
| 4,554,394 | 11/1985 | Forbus et al. | 585/475 |
| 4,577,049 | 3/1986 | Rudnick | 585/486 |

*Primary Examiner*—Helane E. Myers

*Attorney, Agent, or Firm*—Alexander J. McKillop; Charles J. Speciale; Richard D. Stone

[57] ABSTRACT

Conversion of benzene to heavier aromatics by contact with alkyl polynucleararomatics, preferably FCC heavy cycle oil, in the presence of an alkylation/transalkylation catalyst is disclosed. Efficient conversion of relatively dilute benzene in reformate is possible. Use of alkyl polynucleararomatics as a source of alkyl groups, with reduced use of monocyclic alkyl aromatics, permits robust reaction conditions to be used without a net formation of benzene by dealkylation. The process preferably uses a solid zeolite based acidic catalyst disposed in a fixed, moving or fluid bed reactor. Preferred catalysts comprise MCM-22 or ZSM-5.

19 Claims, No Drawings

REDUCTION OF BENZENE CONTENT OF REFORMATE BY REACTION WITH CYCLE OILS

BACKGROUND OF THE INVENTION

1. Field of the Invention

The invention relates to reducing the benzene content of reformate by alkylation and/or transalkylation.

2. Description of Related Art

The present invention relates to an unusual way of upgrading some of the lower value products of two mature processes, catalytic reforming and those producing aromatic rich heavy streams as low value products or by-products, e.g., cycle oils from a catalytic cracking process.

Catalytic reforming of naphtha boiling range feeds over platinum based catalyst to produce high octane reformate has been one of the most successful processes in the world. More than a hundred units are in use, converting low octane naphthas to high octane, aromatic rich gasoline. The only problem with the process is that the product inherently contains large amounts of aromatics, including benzene. Many localities are limiting the amount of benzene which can be contained in gasoline, because of the toxic nature of benzene. Another minor problem in some catalytic reforming units is that the octane number of the gasoline produced varies significantly with boiling range. The light reformate, e.g, the C6− fraction, sometimes has a lower octane than desired and lower than the octane of the C7+ fraction. The C6− fraction can be doubly troubling to refiners, having a shortage of octane and an excess of benzene.

Many processes produce relatively heavy, aromatic rich by-product streams. These are generally characterized by the presence of relatively large amounts of fused polycyclic aromatic compounds which are relatively refractory to further processing, and are generally of low value. FCC cycle oils, coker gas oils, and aromatic extracts from lubricant manufacturing facilities are typical of such streams. Cycle oils from catalytic cracking are the most widely available, so the catalytic cracking process will be briefly reviewed.

Catalytic cracking of hydrocarbons has enjoyed worldwide success. It is probably the method of choice for converting a heavy feed into lighter, more valuable products. Catalytic cracking of hydrocarbons is carried out in the absence of externally supplied H2, in contrast to hydrocracking, in which H2 is added during the cracking step. An inventory of particulate catalyst is continuously cycled between a cracking reactor and a catalyst regenerator. In the fluidized catalytic cracking (FCC) process, hydrocarbon feed contacts catalyst in a reactor at 425° C.-600° C., usually 460° C.-560° C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen containing gas, usually air. Coke burns off, restoring catalyst activity and simultaneously heating the catalyst to, e.g., 500° C-900° C., usually 600° C.-750° C. Flue gas formed by burning coke in the regenerator may be treated for removal of particulates and for conversion of carbon monoxide, after which the flue gas is normally discharged into the atmosphere.

Older FCC units regenerate the spent catalyst in a single dense phase fluidized bed of catalyst. Although there are myriad individual variations, typical designs are shown in U.S. Pat. No. 3,849,291 (Owen) and U.S. Pat. No. 3,894,934 (Owen et al), and U.S. Pat. No. 4,368,114 (Chester et at.) which are incorporated herein by reference.

Most new units are of the High Efficiency Regenerator (H.E.R.) design using a coke combustor, a dilute phase transport riser, and a second dense bed, with recycle of some hot, regenerated catalyst from the second dense bed to the coke combustor. Units of this type are shown in U.S. Pat. No. 3,926,778 (which is incorporated by reference) and many other recent patents. The H.E.R. design is used in most new units.

Another type of catalytic cracking process is moving bed catalytic cracking, or Thermofor Catalytic Cracking (TCC), which is the moving bed analogue of the FCC process.

Both FCC and TCC produce a spectrum of cracked products, ranging from light ends, through heavier products including light and heavy cycle oils. The cycle oils are relatively aromatic streams, rich in single and fused ring alkyl aromatics, i.e., one or perhaps more aromatic rings having single or multiple alkyl side chains attached. These streams are produced in abundance in every cat cracker. They are difficult to upgrade by recycling to the cat cracker in large part because of the large percentage of fused ring aromatic species present. Heavy cycle oil, when recycled to the FCC, usually makes dry gas and coke, with very little gasoline boiling range product produced. The fused ring alkyl aromatics are very stable, and rather than crack to lighter liquid products they tend to dealkylate to form low value light ends, with the dealkylated fused rings condensing to form coke.

The above discussion merely reviews two mature technologies which are widely used, and which produce relatively low value streams, C6 reformate and cycle oils.

We wanted a way to overcome the problem of too much benzene in reformate, at reasonable cost. We at first eliminated the obvious ways of converting the benzene, e.g., use of aromatics extraction units to get a pure (benzene and heavy [light] cycle oil) weight alkylation of the purified benzene with a light olefin. This is a popular way to make toluene, ethylbenzene, and xylene, but the cost of purification and expense of alkylation can not be justified for producing gasoline with a low benzene content.

Others have worked on solving the same problem, such as the work reported in U.S. Pat. No. 4,209,383 (Herout et al). This patent addressed some of the problems of cost containment while converting the benzene. A low benzene content gasoline was made, at reasonable cost, by combining a catalytic reformate and a stripped liquid produced in the gas concentration unit of an FCC. The combined stream was fractionated in a dehexanizer to produce a stream rich in benzene and C3-C4 olefins. This stream was passed to an alkylation zone, where the benzene reacted with the olefins. Fractionation, rather than solvent extraction, was used to achieve some concentration of the benzene fraction. Some capital and operating cost reductions were achieved by mixing the reformate, and the light liquid from the gas con, and fractionating both in the same fractionator. The light ends from the dehexanizer were passed to an alkylation zone, one preferably using solid phosphoric acid catalyst. Although this approach would surely work to reduce the benzene content of a reformate, it does so by consuming light olefins, which many refiners would prefer to convert to non-aromatic gasoline by HF or sulfuric acid alkylation.

Owen, in U.S. Pat. No. 3,969,426, which is incorporated herein by reference, reported that a mixture of durene, benzene and toluene could be converted in a bench scale riser reactor to a substantially durene-free, high quality gasoline product with only a trace loss of carbon to gas or coke. The feed consisted of a mixture of durene (20 wt%) benzene (20 wt%) and toluene (60 wt%). The riser reactor used clean burned, 15 wt% REY zeolite catalyst having a 67.5 FAI. The riser reactor inlet mix temperature was about 800° F., and the cat:oil ratio was 10.12. Essentially complete aromatic carbon retention was achieved, with less than 1 wt% of the feed going to coke, and about 0.5 wt% going to gas. Durene levels were reduced from 20 wt% to 0.2–0.4 wt%. Benzene levels were reduced from 20.0 wt% (feed) to 16.64 to 16.95 wt% (gasoline product).

This reduced the benzene content, but required the addition of durene. The durene, if not almost completely consumed, could appear in the gasoline product and cause problems because of durene's high melting point. The durene tends to remain in the gasoline boiling range product, so if poor conversion of durene occurs the gasoline product may require extensive reprocessing to reduce the durene content to acceptable levels. This approach also requires a source of durene, which is readily available only from methanol to gasoline plants.

We also investigated hydrocracking. Some limited experimental work has been reported on hydrocracking of cycle oils from FCC units. Hydrocracking will be briefly reviewed, and then the experiments, which indicated that cycle oils were better at producing benzene than removing it.

Hydrocracking, like catalytic cracking, is a way to changing the boiling range of a heavy hydrocarbon product. High hydrogen partial pressures, and high or moderate pressures are usually used to convert heavy hydrocarbons into lighter hydrocarbons. Fairly severe hydroprocessing of refractory cycle oils, to saturate them and make them susceptible to cracking in an FCC unit is well known but is not reviewed here.

Hydrocracking FCC Light Cycle Oil and Tetralin Mixtures, in U.S. Pat. No. 4,02,323 Chen et al, occurred at moderate pressure. The tetralin was reported to undergo isomerization, ring opening, dealkylation, alkylation and disproportionation reactions to yield products boiling above and below tetralin. The C5–400° F. fractions consisted mainly of BTX, with a ratio of 2:1:1 (benzene:toluene:xylene).

Both tetralin and FCC cycle oils are known as hydrogen donors. Based on Chen's work, we would have expected a net production of benzene from any fairly severe processing of such hydrogen donor streams.

We then ran some experiments, and found that by selecting the proper operating conditions, and catalyst, and by using a special cofeed, we could achieve the opposite effect, i.e., convert benzene, rather than produce it.

We discovered a way to reduce the benzene content of reformate by reacting it with relatively low value, fused ring alkyl aromatic streams such as cycle oils derived from catalytic cracking units. In contrast to Chen's work, wherein tetralin, and perhaps light cycle oil, was converted to benzene, we were able to react benzene with light cycle oil and reduce the benzene content of the reformate.

Neither catalytic cracking nor hydrocracking are considered reversible reactions, i.e., both processes convert heavier feeds to lighter materials. Neither process is used for the reverse reaction, i.e., to make heavy hydrocarbons from lighter hydrocarbons.

We do not know the exact reaction mechanism by which benzene is converted, but we believe that a significant amount of alkylation and/or transalkylation occurs. We know the best benzene cofeeds are those which contain relatively large numbers of alkyl polynucleararomatics with multiple alkyl side chains. It was surprising that cycle oils, which are a complex mixture of myriad hydrocarbon species, could be used to efficiently convert benzene in reformate to something else. The use of fused ring alkyl aromatics, in preference to alkyl aromatics, permits selection of reaction conditions which promote alkylation or transalkylation reactions with benzene in reformate, without forming more benzene by dealkylation.

BRIEF SUMMARY OF THE INVENTION

Accordingly, the present invention provides a process for converting a benzene containing feed to alkyl aromatics by reacting said benzene with a complex mixture of alkyl polynucleararomatics in a benzene conversion reaction zone operating at benzene conversion conditions sufficient to convert at least 10% of said benzene to alkyl aromatics and produce a product comprising gasoline boiling range hydrocarbons having a reduced benzene content relative to the benzene containing feed.

In another embodiment, the present invention provides a process for reducing the benzene content of a C6 reformate fraction containing 1–25 wt% benzene by reacting said benzene with fused polycyclic aromatic hydrocarbons containing alkyl groups attached thereto in a benzene conversion reaction zone operating at benzene conversion conditions sufficient to convert at least 10% of said benzene to alkyl aromatics and produce a product comprising gasoline boiling range hydrocarbons having a reduced benzene content relative to the reformate feed.

In a more limited embodiment, the present invention provides a process for reducing the benzene content of a C6 reformate fraction having an octane number and containing 1–25 wt% benzene by reacting said benzene with heavy cycle oil from a catalytic cracking unit with an acid acting, zeolite catalyst in a benzene conversion reaction zone operating at a temperature of 655° to 950° F., a catalyst:(benzene and light cycle oil) weight hourly space velocity of 0.5 to 50, and a hydrocarbon partial pressure of 10to 50 psia and converting therein at least 10 % of said benzene to alkyl aromatics and producing gasoline boiling range hydrocarbons having a reduced benzene content relative to the reformate feed and a higher octane number relative to the reformate feed.

DETAILED DESCRIPTION

The present invention can be used to reduce the benzene content of any reformate or any other process stream containing benzene by reacting it with an alkyl polynucleararomatic rich stream derived from any catalytic cracking unit, such as moving bed and fluid bed cat crackers. The process can tolerate quite a variety of benzene containing streams of varying purity, and significant benzene conversions can be achieved using quite a range of catalysts and process conditions.

More details will now be provided on suitable benzene containing feedstocks, polynucleararomatic co-feeds, and catalysts and reaction conditions which may be used.

POLYNUCLEARAROMATICS

The present invention uses alkyl polynuclear aromatics, or as they are sometimes called, poly alkylaromatics, as a source of alkyl groups for the alkylation or transalkylation of benzene in reformate. These materials can be characterized in one way by their complexity and low cost. Chemically they consist of at least two aromatic rings fused together and one or more alkyl side chains. The root aromatic structure is very stable, and severe catalytic or thermal treatment of these materials generally produces coke and light gas and heavy liquid. They generally do not dealkylate to form benzene. Thus these fused ring aromatics are an ideal source of alkyl chains for the conversion of benzene, in that great latitude in processing conditions is possible without inadvertently making benzene (by dealkylation) rather than converting benzene.

These materials have been used as alkyl group acceptors, but not as a source of alkyl groups for the alkylation or transalkylation of benzene. Use of high boiling condensed polynucleararomatic compounds to aid in the dealkylation of durene is exemplified in U.S. Pat. No. 4,577,049 which is incorporated herein by reference. In contrast, the present invention uses alkyl polynucleararomatics to generate alkyl fragments, not receive them.

The preferred alkyl polynucleararomatics for use in the process of the present invention are those obtained as cycle oils from catalytic cracking units, aromatic extracts from lube plants, and coker gas oils or similar materials from thermal conversion processes. Each will be briefly reviewed.

CYCLE OILS

Relatively heavy aromatic hydrocarbons, preferably those with relatively long alkyl side chains, or multiple short alkyl side chains, on condensed polynucleararomatics, are preferred co-feeds to promote reactions with benzene in light reformate. These aromatics, especially those with multiple methyl or ethyl groups per aromatic ring, promote transalkylation reactions which reduce the benzene content of the benzene containing reformate. It is believed that the presence of large amounts of alkyl side chains, especially methyl groups, and to a lesser extent ethyl groups, reduces the equilibrium concentration of benzene in the product discharged from the benzene conversion reactor.

Especially preferred alkyl polynucleararomatics streams are light and heavy cycle oils, and even slurry oils, produced by the FCC. These are relatively refractory to conventional upgrading in the FCC, and are usually relatively low value products of an FCC unit. FCC naphtha, or preferably FCC heavy naphtha may also be used, but these materials are usually more valuable than the cycle oils, and contain less alkyl aromatics than the cycle oils.

Highly preferred cycle oils are those produced by modern, all riser cracking FCC units, such as disclosed in U.S. Pat. No. 4,421,636, which is incorporated by reference.

AROMATIC EXTRACTS

The aromatics rich fraction produced by lube oil refineries is another good source of alkyl polynucleararomatics or fused polycyclic hydrocarbons. Most lube refineries use furfural extraction to produce a low aromatic raffinate fraction containing large amounts of lube oil components. The by-product of furfural extraction is an aromatic rich extract fraction which contains large amounts of aromatics suitable for use herein, and minor amounts of naphthenic materials and almost no paraffins. Such aromatics extracts are rich in the desired alkyl polynucleararomatics, relatively clean, and readily separable from the product gasoline fraction by distillation. Aromatic extracts will be almost free of paraffins, and in this respect they are quite different from some FCC cycle oils, especially those produced by cracking of waxy feeds. FCC processing of high pour point feeds does not usually reduce the pour point of the heavy fuel products, so some FCC cycle oils can contain more than 5 or 10% paraffins, while aromatic extracts generally will not.

COKER GAS OIL

Materials boiling in the gas oil and heavier range produced as a result of thermal processing also contain large amounts of alkyl polynucleararomatics and are believed suitable for use herein, although their properties are somewhat different from catalytically cracked cycle oils, and quite a bit different from aromatic extracts. The coker gas oils generally contain large amounts of olefins, diolefins and other reactive species, and are considered a relatively low value stream in a refinery. Many coker gas oils contain a sufficiently high concentration of polynuclear alkylaromatics to permit their use herein.

Other polynuclear alkylaromatic containing streams having a reactivity with benzene equivalent to that of cycle oils from cat cracking units, coker gas oil, or aromatic extracts, may also be used, though not necessarily with equivalent results.

BENZENE CONTAINING FEED

Any benzene containing feed can be used as a feedstock. Preferred feeds are those produced by conventional reforming, such as reformate from a fixed bed, swing bed, or moving bed reformer operating with a Pt based reforming catalyst.

The most uplift in value will occur when a relatively light reformate, such as a C6, or C6 and lighter fraction, is a majority of the reformate charged to the benzene conversion reactor. Relatively low octane light reformate fractions are especially susceptible to upgrading by the process of the present invention. A benzene and lighter reformate having a research clear octane number of 80 to 85, and preferably of 81 to 84, is readily upgraded in octane while the benzene content thereof is significantly reduced.

Although the present invention does not require a highly purified form of benzene feed, it tolerates relatively purified benzene streams, such as those produced by aromatics extraction units. In some refineries, there may be no demand for the benzene product from an aromatics extraction unit, or the refiner may be forced to extract benzene from a light product stream to comply with a product specification. In these instances, the present invention provides an efficient way to convert these unwanted, though purified, benzene streams, and at the same time increase the production of high octane gasoline. When purified benzene streams are feed to the benzene conversion reactor, the benzene streams may contain significant amounts of other aromatics, e.g, a BT or BTX stream.

It is not essential to have a catalytic reformer in the same refinery as the catalytic cracking unit, although many refineries will contain both processing units. Either the alkyl aromatic rich cofeed, or the reformate, or both, can be imported into the refinery by tank car, pipeline, or similar means.

BENZENE CONVERSION CATALYST/CONDITIONS

Any catalyst which promotes reactions between benzene and polynuclear alkylaromatics such as light cycle oils, without excessive conversion of the cycle oils, can be used herein. The catalyst usually will be an acid acting catalyst, and can be either a solid or liquid. Solids are preferred.

Suitable liquid catalysts include HF, H2SO4, or similar materials. Phosphoric acid on a support can be used.

AlCl3 and similar alkylation/transalkylation catalysts can be used.

Solid catalysts can be 100% amorphous, but preferably include some zeolite in a porous refractory matrix such as silica-alumina, clay, or the like.

Preferably a relatively high activity acid catalyst such as USY, REY, zeolite X, zeolite beta, and other materials having similar crystal structure and activity.

Especially preferred catalysts are shape selective zeolites, i.e., those having a Constraint Index of 1-12, and typified by ZSM-5, and other materials having a similar crystal structure). Another highly preferred catalyst comprises MCM-22. The synthesis of MCM-22 is disclosed in U.S. Pat. No. 4,954,325, which is incorporated herein by reference.

Although any acid acting catalyst can probably be made to work, some general guidelines re. catalyst selectivity can be given. The catalyst should have sufficient acid activity and selectivity to promote the desired alkylation/transalkylation reactions at reasonable temperatures and catalyst space velocities. Conventional acid catalysts for transalkylation are well known, and may be either heterogeneous or homogenous. Convenient acid catalysts include trifluoromethanesulfonic acid and other fluorinated homologs. Preferred catalysts are those which can tolerate quite severe reaction conditions, with zeolite based catalysts having ideal properties.

The catalyst and reaction conditions should not be so active, nor severe, that the alkyl aromatics present, in the feed or produced by alkylation of benzene in the feed, are dealkylated to result in a net production of benzene. As an extreme case, high temperatures can thermally dealkylate any alkyl aromatic into benzene, light ends and coke. Light cycle oils will generally contain both alkylaromatics and polynuclear alkylaromatics. While the fused polycyclic alkylaromatic hydrocarbons are generally not thermally or catalytically degraded to benzene, the monocyclic aromatic hydrocarbons are readily dealkylated to benzene. Use of alkyl rich fused polycyclic aromatics makes our process more robust, in that even if conditions become too severe no benzene should be formed from the polycyclics.

The lower limit on catalyst activity, and on reaction conditions, is sufficient activity to convert at least 10% of the benzene in feed. By conversion of benzene in the feed, we mean that the total number of moles of benzene in the product will be no more than 90% of the total moles of benzene in the feed to the reactor. This also sets an upper limit on severity i.e., it requires minimizing dealkylation sufficiently so that the gasoline boiling range product will have a reduction in benzene content. The volume of gasoline product will generally increase some because some of the alkyl aromatic cycle oil or aromatic extract will be converted into gasoline boiling range hydrocarbons, perhaps by converting benzene into toluene or xylene.

With most catalysts, the following reaction conditions can be used. Temperatures may range from 500° to 1200° F., preferably 600° to 1000° F., and most preferably from about 650° to 950° F. Although fluidized, fixed, or moving bed reactors can be used the relative ratios of feed to catalyst, as applied to fixed beds will be provided. Weight hourly space velocities of 0.1 to 500 preferably 0.2 to 100 and most preferably 0.5 to 50 will usually give good results. Pressure may range from atmospheric, or even subatmospheric, to relatively high pressures, and usually will be from 1 to 1000 psig. Relatively low oil partial pressures, from 5 to 50 psia, are preferred. Hydrogen is not essential, but may be beneficial, particularly in extending catalyst life. When hydrogen is added, it may be present from 0.1:1 to 10:1, expressed as hydrogen to hydrocarbon mole ratios.

EXAMPLE 1

This test was designed to study the ability of an alkyl aromatic stream to convert benzene in a fixed fluidized bed test apparatus used for laboratory simulation of conditions existing in commercial riser reactors.

The tests were conducted two times in the same apparatus with two different feed streams. The first test used a feed of a mixture of 10wt% benzene in FCC naphtha. The second test used a feed of 25% benzene added to FCC light cycle oil (LCO). LCO is much more aromatic than FCC naphtha. The experimental results are reported below:

| | 10% Benzene in FCC Naphtha | 25% Benzene in FCC LCO |
|---|---|---|
| Benzene Conversion, % | 30 | 41 |
| Catalyst/Oil Wt ratio | 15 | 17 |
| Average Temperature, F. | 1000 | 997 |

This example shows that that alkyl aromatics streams, such as FCC LCO, can be used to convert benzene into less toxic species. Expressed as relative amounts of benzene removed, the first feed, benzene in naphtha, removed 3 units of benzene (10 units of benzene in the feed, 30% converted). The second feed, benzene in LCO, removed about 3.5times as much benzene, namely 10.4 units (25 units of benzene in the feed, 41 % converted). A detailed analysis of the feed and product streams for the second test, the one with 25% benzene, and 75% LCO is presented below, in Table 1.

TABLE 1

| Feed Component | Weight % Feed | Weight % Product |
|---|---|---|
| LCO | 75 | 46.7 |
| Coke + Light Gas | 0 | 22.4 |
| Naphtha Range | 25 | 30.9 |
| Naphtha Composition | 25 | 14.6 |
| Benzene | | |
| Alkyl-benzenes | 0 | 9.6 |

TABLE 1-continued

| Feed Component | Weight % Feed | Weight % Product |
|---|---|---|
| PON | 0 | 3.7 |
| Naphthalenes | 0 | 3.0 |
| Benzene Conversion, wt % | — | 41% |
| Naphtha range, Ca. | .92 | .72 |
| Naphtha Blending RON | 103.4 | 103.8 |
| Blending RON of non-Benzene fraction of naphtha | — | 104.3 |

We have found that the octane blending values for RON and MON increase from benzene to toluene to xylene by about 2–3 octane for each methyl group added. Thus the actual upgrade should be taken on the generated product, with the unconverted benzene being recycled back to the reactor with more LCO.

EXAMPLE 2 (MCM-22)

This example shows adding an alkylation additive, such as MCM-22, improves the effectiveness of conventional FCC catalyst at promoting alkylation/transalkylation reactions.

In this example a conventional, equilibrium FCC catalyst, called Catalyst A, was tested alone and blended with MCM-22 to a 5wt% zeolite basis. The feed is an FCC naphtha spiked to 10 wt% benzene. In addition to benzene conversion with the MCM-22 additive, paraffins are significantly reduced in the naphtha relative to pure Catalyst A. This increases production of light gases, especially C4's and lighter. Addition of MCM-22 thus increases alkylation/transalkylation reactions, and also increases olefin production from the FCC. The results are reported in Table 2.

TABLE 2

| Catalyst | A + Additive | A |
|---|---|---|
| MB# | 82 | 42 |
| Temp | 1098 | 1083 |
| cat/oil | 18.1 | 20.7 |
| C5 + gasoline | 71.3 | 80.5 |
| C4's | 7.1 | 5.1 |
| Dry Gas | 13.1 | 7.1 |
| coke | 8.3 | 7.3 |
| RON | 103.3 | 101.8 |
| MON | 95.9 | — |
| Naphtha Composition, Total Feed Basis | | |
| Paraffins | 5.9 | 11.6 |
| Olef | 1.4 | 0.9 |
| DiOlef | 0 | 0 |
| Naphthenes | 0.7 | 1.9 |
| Benzene | 7.7 | 9.2 |
| Toluene | 13.6 | 12.8 |
| Xylenes | 17.4 | 18.9 |
| TrimethylBZ | 6.7 | 8.1 |
| Other AlkylBZ | 7.3 | 9.9 |
| Naphthalenes | 6.1 | 3.6 |
| Unknown Sats | 0 | 0 |
| Unknown Arom | 4.3 | 3.3 |
| wt % Arom. C | 45.9 | 47.3 |
| RON | 103.3 | 102.6 |
| (Normalized to nearest 100 F. (1100 F./1000 F.) | | |

DISCUSSION

Reaction of heavy alkyl aromatics, such as FCC cycle oils with benzene containing streams will convert benzene to toluene, xylene and higher alkyl benzenes and achieve limited conversion of the heavy aromatic streams. The process of our invention provides a powerful and cost effective way for refiners to reduce the benzene content of reformate fractions, and produce gasoline product have a high octane number and a reduced aromatic content. Low value cycle oils are converted at least in part to a low benzene content gasoline fraction. This conversion of cycle oils is somewhat surprising in that prior attempts to convert cycle oils to lighter materials produced benzene.

The process of the present invention also works well despite the use of complex, relatively impure streams. It represents a much better use of FCC cycle oils than anything proposed in the art. Severe hydrotreating, to make cycle oils less refractory, is expensive, while mild hydrocracking simply makes more benzene. Using the process of our invention, cycle oils shift from being something of a distress stock to a valuable precursor of low benzene content gasoline.

The process can be easily implemented in existing refineries. A relatively small fixed or fluidized bed benzene conversion reactor can be used to react a benzene containing reformate with a cycle oil from a cat cracking unit. Reaction conditions can be adjusted to optimize the desired benzene conversion, and to optimize catalyst life/activity.

We claim:

1. A process for converting a C6 reformate fraction containing 1–25 wt% benzene to alkyl aromatics by reacting said benzene containing reformate fraction with a complex mixture of alkyl polynucleararomatics in a benzene conversion reaction zone operating at benzene conversion conditions sufficient to convert at least 10% of said benzene to alkyl aromatics and produce a product comprising gasoline boiling range hydrocarbons having a reduced benzene content relative to the C6 reformate fraction feed.

2. The process of claim 1 wherein the complex mixture of alkyl polynucleararomatics is a cycle oil or heavy naphtha produced by a catalytic cracking unit.

3. The process of claim 2 wherein the complex mixture of alkyl polynucleararomatics is a heavy cycle oil.

4. The process of claim 1 wherein the complex mixture of alkyl polynucleararomatics is an aromatic extract.

5. The process of claim 1 wherein the complex mixture of alkyl polynucleararomatics is coker gas oil.

6. The process of claim 1 wherein the C6 reformate fraction consists essentially of a C6 boiling range reformate fraction.

7. The process of claim 1 wherein the C6 reformate fraction consists essentially of a C6 and lighter boiling range reformate fraction.

8. The process of claim 1 wherein the benzene conversion reaction zone comprises a fixed, moving or fluidized bed of an acid acting catalyst.

9. The process of claim 1 where the benzene conversion reaction zone operates at a temperature of 500° to 1200° F., a catalyst:aromatic hydrocarbon weight hourly space velocity of 0.1 to 500, and a hydrocarbon partial pressure of 5 to 1000 psia.

10. The process of claim 1 where the benzene conversion reaction zone operates at a temperature of 655° to 950° F., a catalyst:aromatic hydrocarbon weight hourly space velocity of 0.5 to 50, and a hydrocarbon partial pressure of 10 to 50 psia.

11. The process of claim 1 wherein the acid acting catalyst comprises at least one of MCM-22 and ZSM-5.

12. The process of claim 1 wherein the acid acting catalyst is MCM-22.

13. A process for reducing the benzene content of a C6 reformate fraction containing 1–25 wt% benzene by reacting said benzene with polynucleararomatic hydrocarbons containing alkyl groups attached thereto in a benzene conversion reaction zone operating at benzene conversion conditions sufficient to convert at least 10% of said benzene to alkyl aromatics and produce a product comprising gasoline boiling range hydrocarbons having a reduced benzene content relative to the reformate feed.

14. The process of claim 13 wherein the benzene conversion reaction zone operates at a temperature of 500° to 1200° F., a catalyst:aromatic hydrocarbon weight hourly space velocity of 0.1 to 500, and a hydrocarbon partial pressure of 5 to 1000 psia.

15. The process of claim 13 wherein the benzene conversion reaction zone operates at a temperature of 655° to 950° F., a catalyst:aromatic hydrocarbon weight hourly space velocity of 0.5 to 50, and a hydrocarbon partial pressure of 10 to 50 psia.

16. The process of claim 13 wherein the acid acting catalyst comprises at least one of MCM-22 and ZSM-5.

17. The process of claim 13 wherein the acid acting catalyst is MCM-22.

18. The process of claim 13 wherein the polynucleararomatics are selected from the group of heavy cycle oil from a catalytic cracking unit, coker gas oil, and an aromatics extract from a lubricant refinery.

19. A process for reducing the benzene content of a C6 reformate fraction having an octane number and containing 1–25 wt% benzene by reacting said benzene with heavy cycle oil from a catalytic cracking unit with an acid acting, zeolite catalyst in a benzene conversion reaction zone operating at a temperature of 655° to 950° F., a catalyst:(benzene and heavy cycle oil) weight hourly space velocity of 0.5 to 50, and a hydrocarbon partial pressure of 10 to 50 psia and converting therein at least 10% of said benzene to alkyl aromatics and producing gasoline boiling range hydrocarbons having a reduced benzene content relative to the reformate feed and a higher octane number relative to the reformate feed.

* * * * *